United States Patent [19]

Seido

[11] Patent Number: 4,616,767

[45] Date of Patent: Oct. 14, 1986

[54] TISSUE PAPER BOX

[76] Inventor: Mitsuro Seido, 26 Ooaza Maemachi, Kuroishi-shi, Aomori-ken, Japan

[21] Appl. No.: 618,610

[22] Filed: Jun. 8, 1984

[30] Foreign Application Priority Data

Jun. 9, 1983 [JP] Japan ..... 58-88870[U]

[51] Int. Cl.[4] ..... A47K 10/42; B65H 1/04

[52] U.S. Cl. ..... 221/58; 221/65

[58] Field of Search ..... 221/56, 57, 260, 47, 221/58, 65

[56] References Cited

U.S. PATENT DOCUMENTS

| | | | |
|---|---|---|---|
| 1,218,196 | 3/1917 | McCorkindale | 221/58 X |
| 1,593,532 | 7/1926 | Hansen | 221/58 X |
| 3,197,062 | 7/1965 | Day et al. | 221/65 X |

*Primary Examiner*—F. J. Bartuska

*Attorney, Agent, or Firm*—David A. Jackson; Daniel H. Bobis

[57] ABSTRACT

A tissue paper box includes a plurality of side walls, a bottom wall and a top wall which define an enclosure for containing tissue papers; the top wall being cut-away to define a paper outlet through which the tissue papers can be removed; the side walls being collapsible to provide the tissue paper box in compact form after at least some of the tissue papers are removed therefrom; and at least one elastic strip secured to interior surfaces of the walls of the box for biasing the tissue papers toward the paper outlet, the at least one elastic strip being at least partly removable through the paper outlet when all of the tissue papers are removed from the box, to be wrapped around the box so as to maintain the box in the collapsed, compact form.

3 Claims, 20 Drawing Figures

TISSUE PAPER BOX

BACKGROUND OF THE INVENTION

1. Field of the Invention

This invention relates to an improvement in a box for tissue paper folded alternatingly and placed one on top of another, in the box. Specifically, the invention is provided to overcome the problem where the paper cannot be taken out continuously to the last sheet since when the amount of paper remaining in the box becomes small, the paper becomes separated, due to its own weight, from the one being taken out from a paper outlet. Thus, according to the invention, there is provided a box having an elastic strip which urges the tissue paper constantly upward. Due to the upward pressure of the elastic strip, the paper can be continuously taken out to the last sheet. Further, the box from which all the paper is used, can be collapsed in a compact form and, accordingly, the box can be conveniently discarded into a trash box or the like, according to the invention.

2. Description of the Prior Art

In general, a tissue paper box is provided with a paper outlet longitudinally at a center part of the top plate of the box and a film having a slit through which paper is taken out, is adhered to the back surface of the plate.

When a tissue paper is pulled out from the box through the slit, the next paper end is taken out from the slit. In this way the paper is taken out continuously one by one from the box. However, when the remaining amount of paper in the box become less than one-half full and, accordingly, when the paper being taken out must travel over half of the total height of the box, the next paper is sometimes torn off from the one being taken out due to its own weight, prior to the time that the paper is pulled up to the slit position and, consequently, the separate sheets of paper become disconnected.

In order to overcome the inconvenience above, it has been proposed to provide the bottom wall of the box with a seam line so as to form a stand-up piece. When the phenomenon mentioned above occurs, the stand-up piece which is separated along the seam line and then folded within the box in a manner, pushes up the tissue paper. In this way, the paper can be taken out smoothly to the last sheet in the same manner that the first sheet is taken out.

In the structure above, however, a manual step is necessary to separate the piece and to fold it within the box. Further, the piece is made of a material the same as that of the box and, accordingly since it has a recovering property, its pushing-up force is gradually reduced, whereby the pulling-out procedure becomes gradually difficult.

The used box from which all the paper has been taken out, is also inconvenient with respect to discarding it into a trash box since it still has a box form and is voluminous. Even if it is folded, it will recover its original shape. Since it is made of thick paper, considerable power is necessary to break the box down.

SUMMARY OF THE INVENTION

It is an inherent object of the invention to provide a tissue paper box from which tissue paper can be continuously taken out to the last paper without the need of any additional manual operation.

It is a further object of the invention to provide a tissue paper box which can be crushed into a compact form so as to be discarded conveniently.

In order that the invention may be more clearly understood, preferred embodiments will be described, by way of example, with reference to the accompanying drawings.

DETAILED DESCRIPTION OF THE PREFERRED EMBODIMENTS

Figure 1:
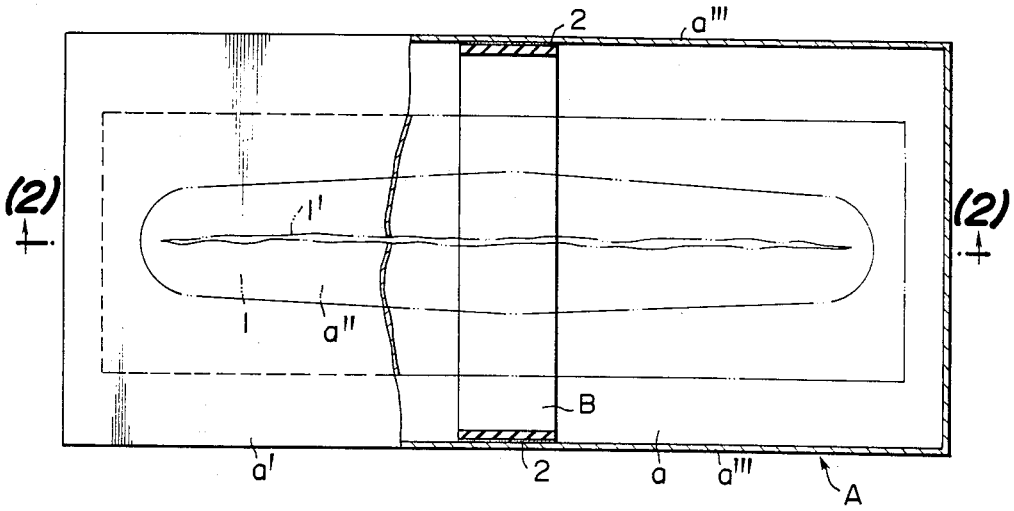
FIG. 1 is a plan view, partly in section, of the tissue paper box according to the invention.
Figure 2:
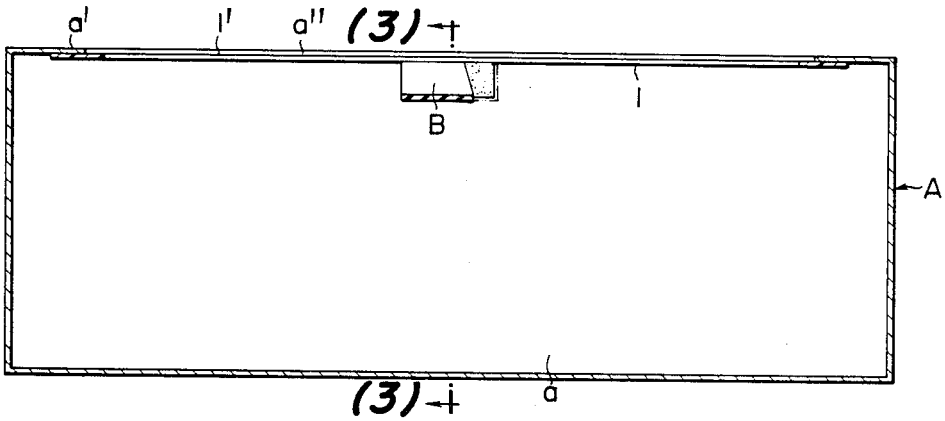
FIG. 2 is a sectional view of the tissue paper box taken along line (2)—(2) in FIG. 1.
Figure 3:
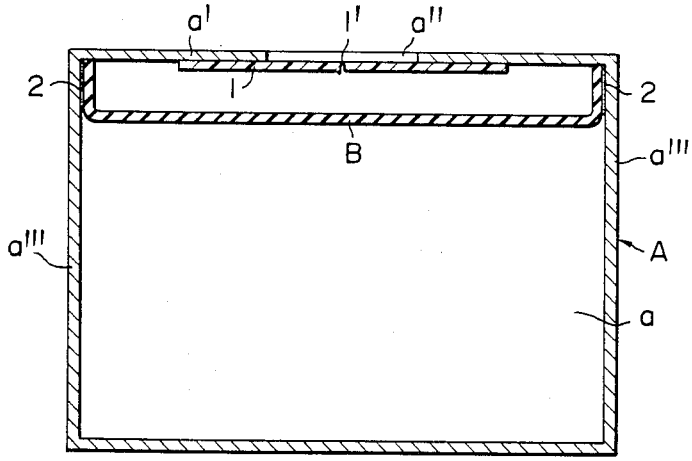
FIG. 3 is a sectional view of the tissue paper box taken along line (3)—(3) in FIG. 2.
Figure 4:
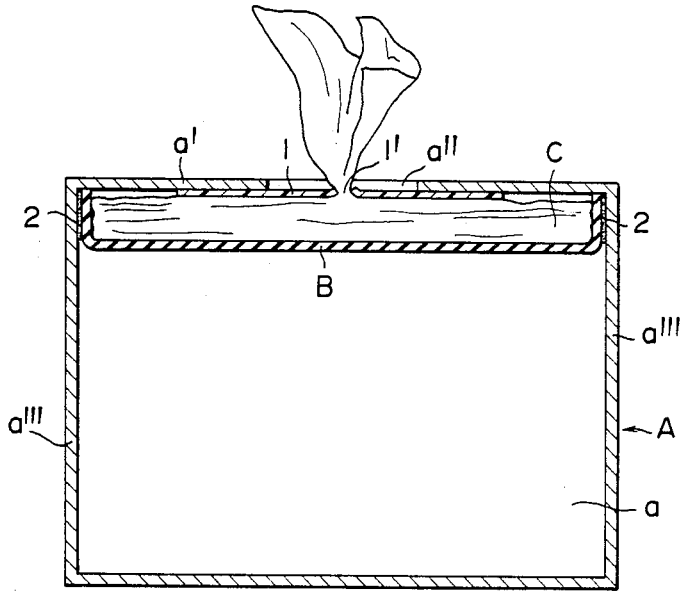
FIGS. 4 and 5 respectively are sectional views of the box in used condition.
Figure 5:
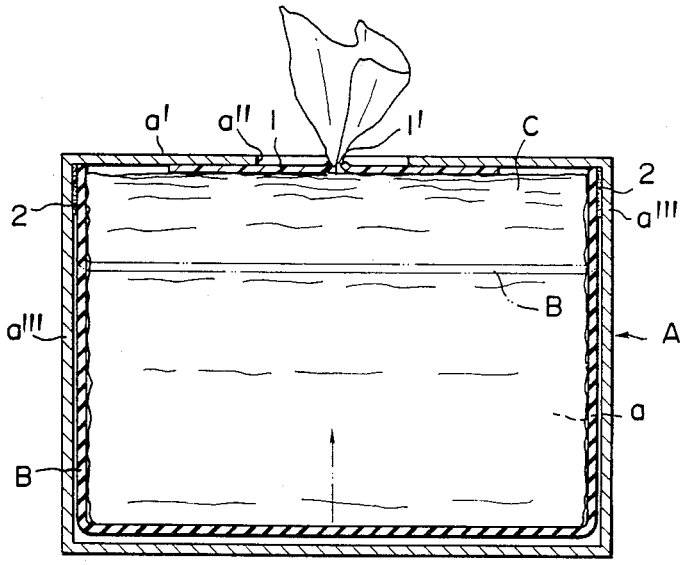

The box A is made of rigid paper such as card board with a paper room a therewithin. A top plate a′ is provided longitudinally with a paper outlet a″. Film 1 pasted to the back side of the top wall a′, and is provided, with a slit 1′ through which paper is taken out. The box body itself mentioned above is well known. The box A, however, is provided with elastic strips B as shown in FIG. 3, according to the invention.

The elastic strip B urges paper mass C in the paper room a to the paper outlet a″, and consists of elastic material such as a rubber strip, rubber band and rubber ring. One or a plurality of strips is preferred to be extended between side walls a‴ in a manner to cross the outlet a″. If desired, however, the strip can be provided parallel to the outlet a″ at a position below the outlet or below the top wall. The strip can be fixed to the side walls at the position 2 by means of a hook, paper fastener, adhesive, adhesive tape and so on.

Figure 6:
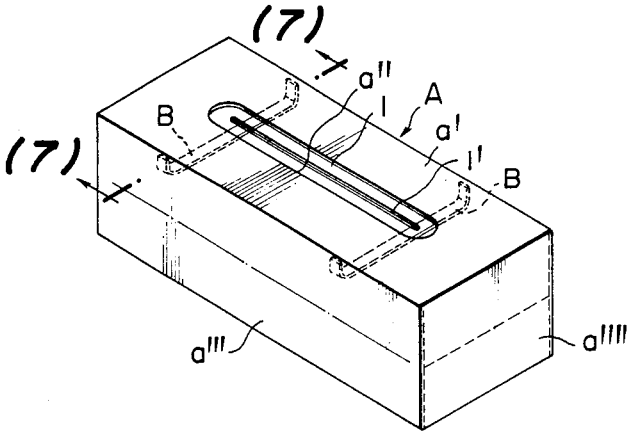
FIG. 6 is a perspective view of the box in which two elastic strips are provided.
Figure 7:
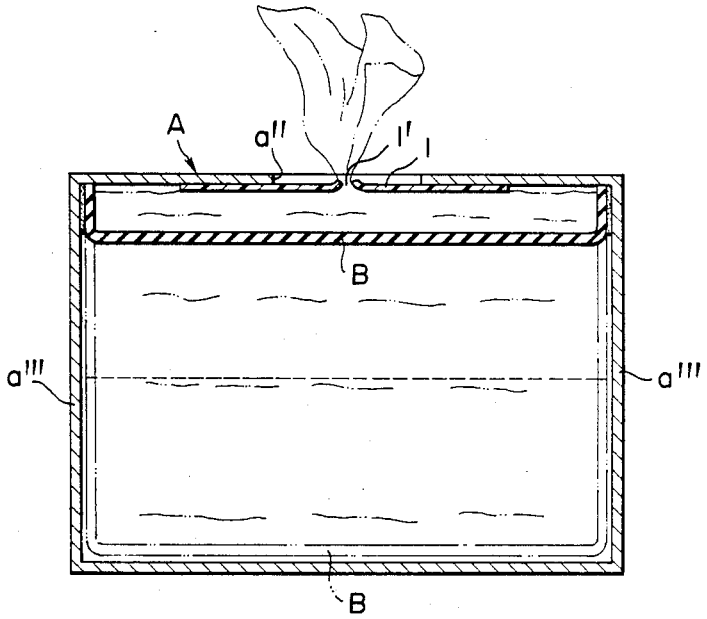
FIG. 7 is an enlarged sectional view of the box taken along line (7)—(7) in FIG. 6.
Figure 8:
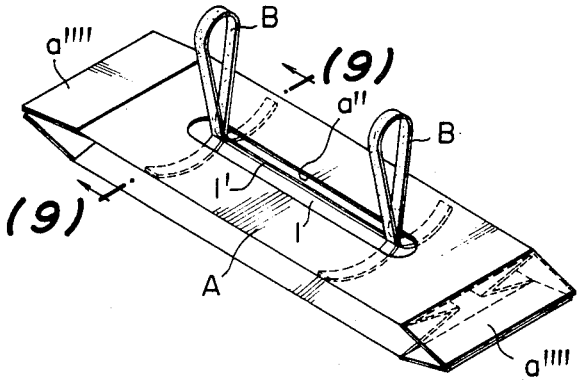
FIG. 8 is a perspective view of the box in a collapsed condition where the two strips have been taken away.
Figure 9:
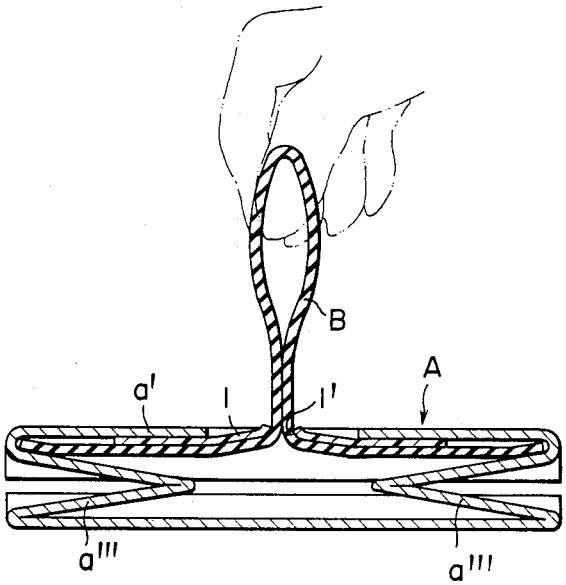
FIG. 9 is an enlarged perspective view of the collapsed box along line (9)—(9) in FIG. 8.
Figure 10:
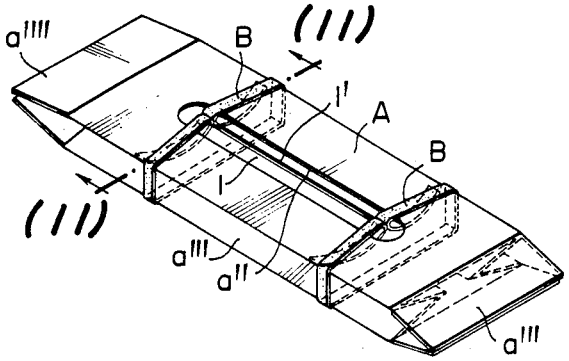
FIG. 10 is a perspective view of the collapsed box around which two strips are wound.

In FIG. 6, two elastic strips B are provided between side walls a‴, at a position below the paper outlet a″ and at the upper part of the box. The paper is constantly urged upperward i.e. to the direction of the outlet, just as in the embodiment mentioned previously. According to this embodiment shown in FIG. 6, even in the state where a small amount of paper remains in the box, the paper is supported horizontally by the two strips and, therefore, a side part of the remaining paper will not hang down.

A single strip or a plurality of strips can be used for urging the paper upward, and for holding the box after collapsed.

Operation for collapsing the box and holding the collapsed box by the strip is explained with reference to FIGS. 8 through 17.

First, after the tissue paper is consumed, the box A is divided along a line at approximately middle height of the longitudinal side walls a''''. Then side walls a''' are folded inside in a V shape along line at approximately middle height, so that the box A is collapsed flat.

Figure 11:
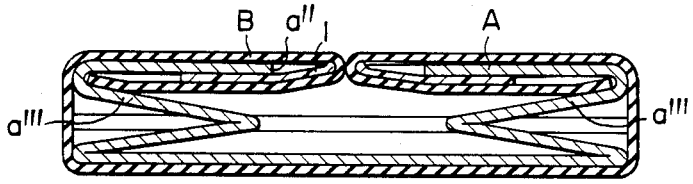
FIG. 11 is an enlarged sectional view of the box taken along line (11)—(11) in FIG. 10.

After the strips B extended in the box are drawn out from the paper outlet a'', the strips are reversed to the back side with the result that the flat box A is held by the rubber strips, as shown in FIG. 11.

Thus, since the used box is folded flat and held by rubber rings or bands, the box is not voluminous. Accordingly, the box can be conveniently discarded into a trash box.

In collapsing the box A to a flat shape, if folding lines for example, are previously formed along the side walls, the collapsing operation can be easily effected.

FIGS. 12 through 14, and FIGS. 15 and 16, respectively, show other embodiments for folding the box A into a flat shape.

Figure 12:
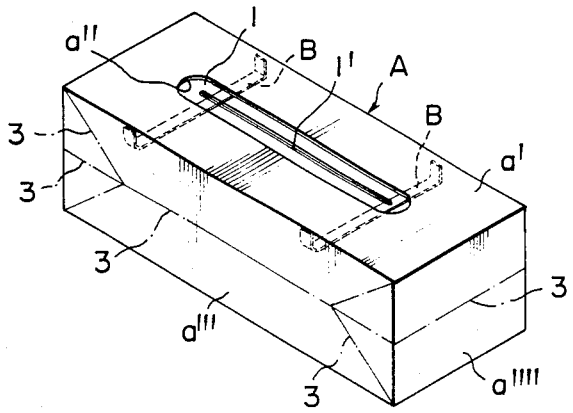
FIGS. 12 through 14 and FIGS. 15 through 17 respectively, are perspective views of the box of other embodiments according to the invention.
Figure 13:
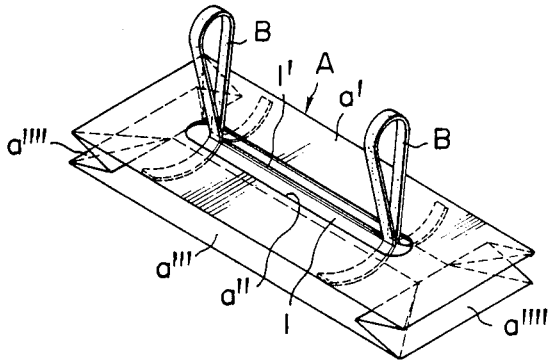
Figure 14:
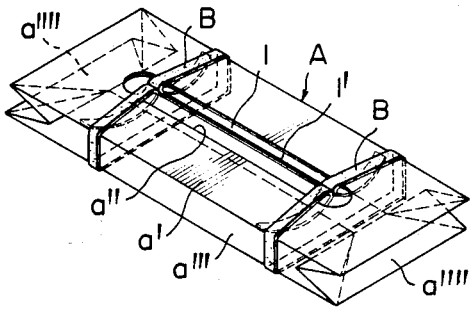

According to the embodiment shown in FIGS. 12 through 14, side walls a''' and a'''' are folded inwardly in a V shape along the line 3 at approximately middle height of the box. Then, two elastic strips are drawn out from a slit a'' and reversed to the back side in a manner to fold up the box, in the same manner as explained with the previous embodiments.

Figure 15:
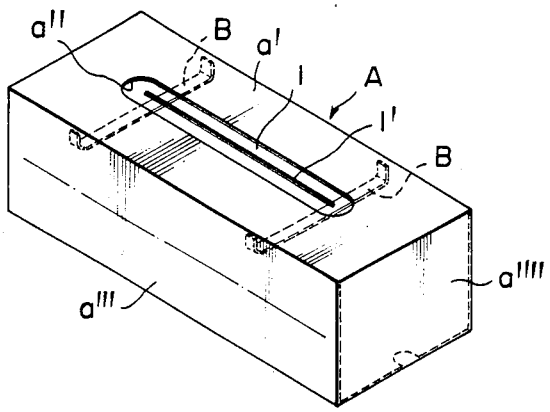
Figure 16:
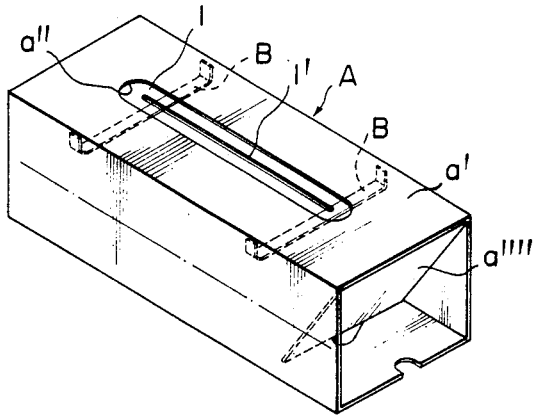
Figure 17:
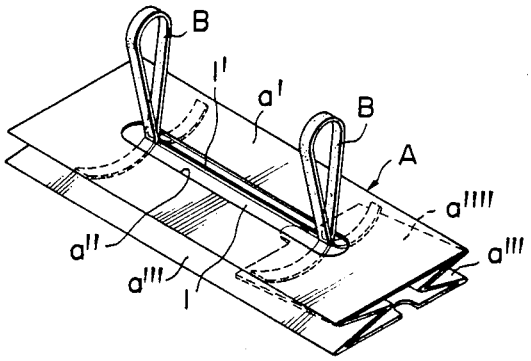

According to the embodiment shown in FIGS. 15 through 17, only one edge of the side walls a'''' is retained and the other three edges are cut out. The cut out walls are folded inwardly as shown in FIG. 16. The side walls a''' are folded inwardly in a V shape and thus a flat box is formed. From the box the elastic strip B is drawn out and wrapped around the box as in the previous embodiment, so that the collapsed box A may not be expanded.

Figure 18:
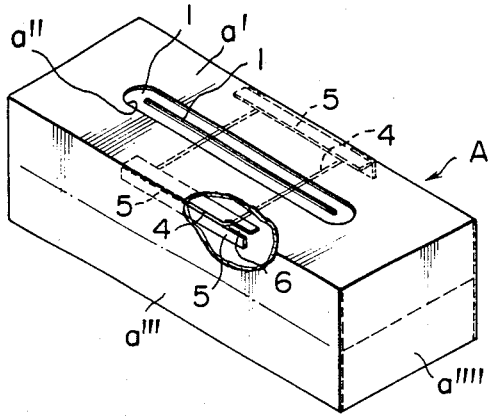
FIG. 18 is a perspective view, partly in section, of the box where two rubber rings are used as elastic strips.
Figure 19:
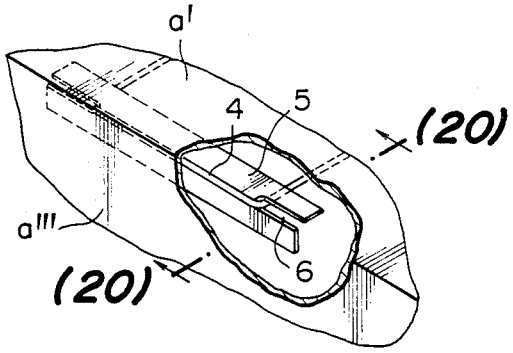
FIG. 19 is an enlarged view of the main part of the box of FIG. 18.
Figure 20:
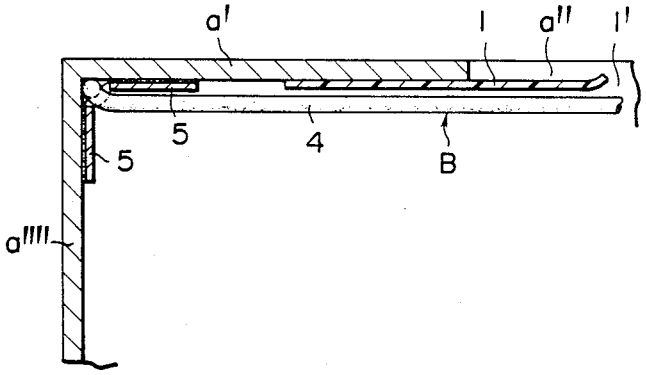
FIG. 20 is an enlarged sectional view of the main part taken along line (20)—(20) in FIG. 19.

FIG. 18 shows a structure where a rubber ring 4 is used as an elastic strip B. The ring is extended in a rectangular form in such a manner that opposite sides are fixed by adhesive tape 5 along the folded corner between side walls a''' and the top plate a'. The ends of the tape 5 are separated apart in a manner to place the ring 4 between a groove 6 formed as shown in FIG. 19, so that the tape ends may not be peeled off by the pulling force of the ring and so that the tape may be firmly fixed to the box.

With the structure mentioned above, the paper is constantly urged upwardly without the need of a finger operation even when the remaining amount of tissue paper becomes small and, consequently, all the paper can be taken out, without failure, to the last paper.

It will be understood by those skilled in the art that the foregoing description is that of preferred embodiments of the disclosed tissue paper box and that various changes and modifications may be made in the invention without departing from the spirit and scope thereof.

What is claimed is:

1. A tissue paper box comprising:

a plurality of side walls, a bottom wall and a top wall which define an enclosure for containing tissue papers;

said top wall being cut-away to define a paper outlet through which said tissue papers can be removed;

said side walls being collapsible to provide said tissue paper box in compact form after at least some of said tissue papers are removed therefrom;

at least one elastic strip provided in said box and secured to interior surfaces of at least one wall of said box for biasing said tissue papers toward said paper outlet, said at least one elastic strip being at least partly removable through said paper outlet when all of said tissue papers are removed from said box, to be wrapped around said box so as to maintain said box in said collapsed, compact form.

2. A tissue paper box according to claim 1; further including tape means for securing said at least one elastic strip to said interior surfaces.

3. A tissue paper box according to claim 1; wherein said side walls include fold lines about which said side walls can be collapsed.

* * * * *